US006337962B1

(12) United States Patent
Inoue et al.

(10) Patent No.: US 6,337,962 B1
(45) Date of Patent: Jan. 8, 2002

(54) PROCESS CARTRIDGE AND ELECTROPHOTOGRAPHIC APPARATUS

(75) Inventors: Hiroshi Inoue, Kamakura; Yuji Ishihara, Numazu; Naoki Fuei, Odawara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/637,111

(22) Filed: Aug. 11, 2000

(30) Foreign Application Priority Data

Aug. 12, 1999 (JP) ..... 11-228772

(51) Int. Cl.[7] ..... G03G 15/08

(52) U.S. Cl. ..... 399/111; 399/115; 399/174; 399/176

(58) Field of Search ..... 399/50, 111, 115, 399/116, 159, 174, 176; 430/56, 78

(56) References Cited

U.S. PATENT DOCUMENTS

| | | | | |
|---|---|---|---|---|
| 4,851,960 A | | 7/1989 | Nakamura et al. | 361/225 |
| 5,713,067 A | | 1/1998 | Mizoe et al. | 399/176 |
| 5,864,731 A | * | 1/1999 | Ikemoto et al. | 399/27 |
| 6,035,162 A | * | 3/2000 | Chigono | 399/175 |

FOREIGN PATENT DOCUMENTS

| | | |
|---|---|---|
| JP | 63-149669 | 6/1988 |
| JP | 5-341626 | 12/1993 |
| JP | 10-26866 | 1/1998 |

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

A process cartridge has an electrophotographic photosenstive member and a conducting member disposed in contact with the electrophotographic photosenstive member and to which a voltage is to be applied. The electrophotographic photosensitive member and conducting member are supported as one unit and are detachably mountable to the main body of an electrophotographic apparatus. The electrophotographic photosenstive member has a support, and provided thereon are a charge generation layer and a charge trasport layer in this order. The charge transport layer having a thickness of from 12 $\mu$m to 40 $\mu$m and the conducting member has a conductive support and a covering layer provided thereon. The time constant $\tau$ of electric current of the conducting member is 0.1 second or shorter.

36 Claims, 5 Drawing Sheets

PROCESS CARTRIDGE AND ELECTROPHOTOGRAPHIC APPARATUS

BACKGROUND OF THE INVENTION

1. Field of the Invention

This invention relates to an electrophotographic photosensitive member and a conducting member which are used in a process cartridge and an electrophotographic apparatus. More particularly, it relates to a conducting member which electrically controls contact-object members, such as electrophotographic photosensitive members, charging members, developer-carrying members, transfer members, cleaning members and charge-eliminating members, which are used in electrophotographic apparatus, such as printers, facsimile machines and copying machines and in process cartridges detachably mountable to these apparatus.

2. Related Background Art

Charging processes in electrophotographic processes have conventionally widely employed a corona charging assembly with which the surface of a charging object-member photosensitive member is uniformly charged to a stated polarity and potential by a corona shower generated by applying a high voltage (DC voltage of 6 to 8 kV) to a metal wire. However, there have been problems such as the requirement for a high-voltage power source and the generation of ozone in a relatively large quantity.

As a countermeasure thereto, a contact charging system, in which a voltage is applied while bringing a charging member into contact with a photosensitive member to charge the surface of the photosensitive member, has put into practical use. This is a system in which a roller type, blade type, brush type or magnetic brush type charging member, serving as an electric-charge feed member, is brought into contact with a photosensitive member and a stated charging bias is applied to this contact charging member to uniformly charge the photosensitive member surface to a stated polarity and potential.

This charging system has the advantages that power sources can be made low-voltage and the generation of ozone can be lessened. In particular, a roller charging system employing a conductive roller (charging roller) as the contact charging member is preferably used in view of the stability of charging. With regard to the uniformity of charging, however, it is a little disadvantageous over the corona charging assembly.

In order to improve charging uniformity, as disclosed in Japanese Patent Application Laid-Open No. 63-149669, an "AC charging system" is used in which an alternating voltage component (AC voltage component) having a peak-to-peak voltage that is at least twice the charge-starting voltage ($V^{TH}$) is superimposed on a DC voltage corresponding to the desired charging object surface potential Vd and a voltage thus formed (a pulsating voltage whose value changes periodically with time) is applied to the contact charging member. This system aims at the potential-leveling effect attributable to AC voltage. The potential of the charging object member converges on the potential Vd, which is the middle of the peak of AC voltage, and is not affected by any external disorder in the environment or the like. Thus, this is as good a method as the contact charging method.

Since, however, this method uses a high-voltage AC voltage having a peak-to-peak voltage that is at least twice the discharge-starting voltage ($V^{TH}$) at the time of the application of DC voltage is superimposed, an AC power source is required in addition to a DC power source. This causes the apparatus itself to have a high cost. Moreover, since AC current is consumed in large quantities, there has been a problem that the running performance of the charging roller and the photosensitive member tends to decrease.

These problems can be solved by applying only DC voltage to the charging roller to effect charging. However, the application of only DC voltage to the charging roller has caused the following problems.

The application of only DC voltage to a conventional charging member causes, on the surface of the charging object member such as the photosensitive member, an uneven potential due to excessive charging beyond the desired charge potential (hereinafter "excessive-charging uneven potential"). In particular, in an electrophotographic process having no pre-exposure, which is a step for eliminating before primary charging the potential on the photosensitive member, such excessive-charging uneven potential tends to occur at potential portions of halftone image areas. Where the photosensitive-member surface potential at halftone potential portions is measured with a surface potentiometer, an uneven potential due to charging as excessive as about tens of volts in potential difference is observable at places corresponding to the second- and subsequent-round positions on the photosensitive member.

When halftone images are reproduced using a conventional charging roller causing such a problem, by means of, e.g., an electrophotographic apparatus employing a reversal development system, there has been a problem that the above excessive-charging uneven potential appears on images as partially blank or coarse halftone image areas, resulting in a low image quality. This excessive-charging uneven potential tends to especially remarkably occur in a low-temperature and low-humidity environment.

As a method in which only the DC voltage is applied to achieve a uniformity of charging, Japanese Patent Application Laid-Open No. 5-341626 discloses a technique in which an upstream-side microgap, formed between the charging member and the charging object member, is irradiated by light (nip exposure) to remove electric charges from the charging object-member surface, which is then charged via a downstream-side microgap. By this method, the charging object-member surface can be charged relatively uniformly, but not satisfactorily.

In the electrophotographic apparatus employing the contact charging system, uneven image density may also occur because of faulty charging due to contamination of the charging member (adhesion of developer to its surface), which tends to cause a problem with running performance. Accordingly, in order to enable many-sheet printing, it has been a pressing need to prevent the influence of faulty charging due to contamination of the charging member. Especially in the case of the DC charging system where only the DC voltage is applied to the charging member, the influence of contamination of the charging member tends to cause more faulty images than in the case of the AC charging system.

SUMMARY OF THE INVENTION

The present invention was made taking account of the foregoing. Accordingly, an object of the present invention is to provide a process cartridge, and an electrophotographic apparatus, which may hardly cause an excessive-charging uneven potential even when the charging object member is charged by applying only DC voltage to a conducting member.

Another object of the present invention is to provide a process cartridge, and an electrophotographic apparatus, which may hardly cause faulty charging due to contamination of a conducting member and can maintain a good charging performance over a long period of time.

To achieve the above objects, the present invention provides a process cartridge comprising an electrophotographic photosensitive member and a conducting member disposed in contact with the electrophotographic photosensitive member and to which a voltage is to be applied;

the electrophotographic photosensitive member and conducting member being supported as one unit and being detachably mountable to the main body of an electrophotographic apparatus;

the electrophotographic photosensitive member comprising a support, and a charge generation layer and a charge transport layer in this order provided on the support; the charge transport layer having a thickness of from 12 $\mu$m to 40 $\mu$m; and the conducting member comprising a conductive support and a covering layer provided thereon; the time constant $\tau$ of electric current of the conducting member being 0.1 second or shorter.

The present invention also provides an electrophotographic apparatus comprising an electrophotographic photosensitive member and a conducting member disposed in contact with the electrophotographic photosensitive member and to which a voltage is to be applied;

the electrophotographic photosensitive member comprising a support, and a charge generation layer and a charge transport layer provided on the support in this order; the charge transport layer having a thickness of from 12 $\mu$m to 40 $\mu$m; and the conducting member comprising a conductive support and a covering layer provided thereon; the time constant $\tau$ of electric current of the conducting member being 0.1 second or shorter.

DETAILED DESCRIPTION OF THE PREFERRED EMBODIMENTS

The process cartridge and electrophotographic apparatus of the present invention has an electrophotographic photosensitive member and a conducting member (serving as a charging member) disposed in contact with the electrophotographic photosensitive member.

The electrophotographic photosensitive member used in the present invention comprises a support, and a charge generation layer and a charge transport layer provided on the support in this order. The charge transport layer has a thickness of from 12 to 40 $\mu$m.

The conducting member comprises a conductive support and a covering layer provided thereon, and the time constant $\tau$ of electric current of the conducting member is 0.1 second or shorter.

Figure 1:
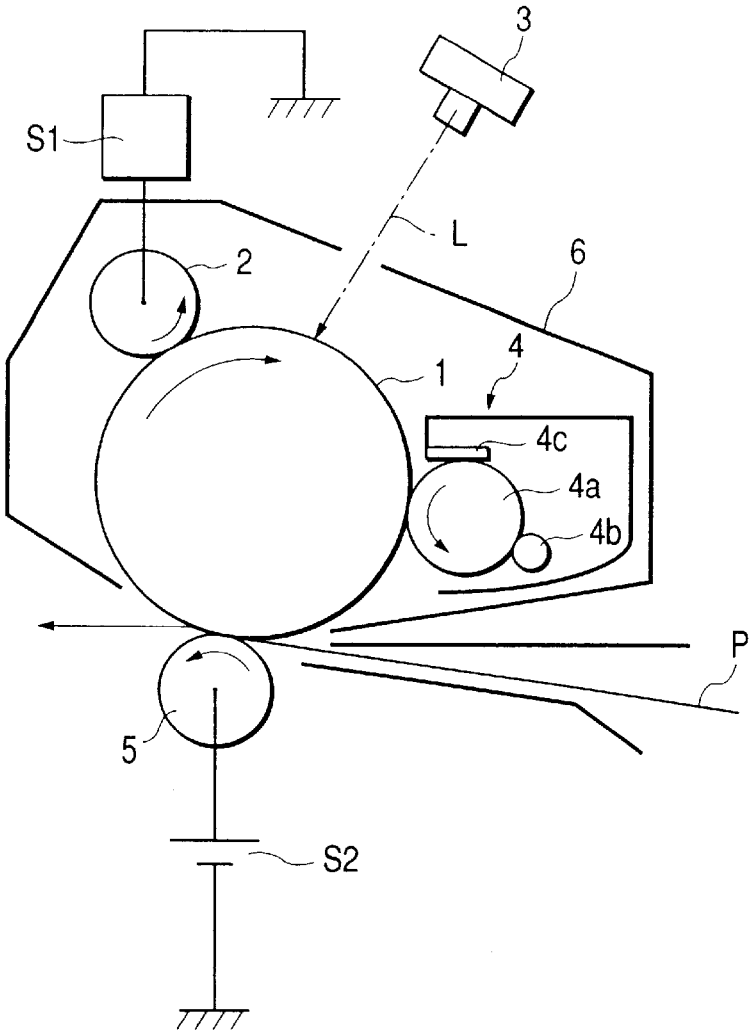
FIG. 1 is a schematic illustration of the construction of an electrophotographic apparatus of the present invention.

FIG. 1 shows an electrophotographic apparatus making use of the conducting member of the present invention as a charging member (charging roller). Application of a voltage to this charging member causes electric discharge at the microscopic space defined between the charging member and the photosensitive member to charge the photosensitive member surface electrostatically.

Figure 4:
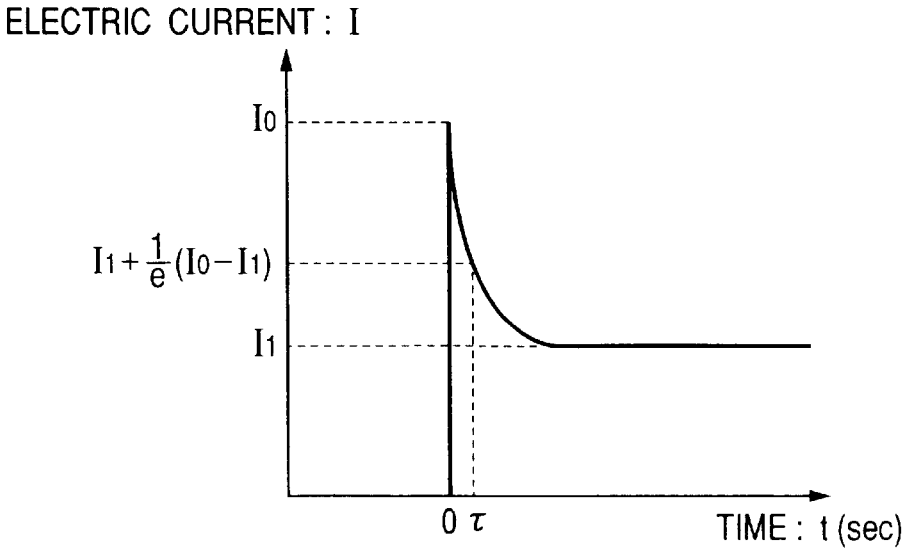
FIG. 4 is a schematic representation showing how the value of electric current of a charging member shifts with time.

Our studies have revealed that the electric current flowing from the charging member assumes an attenuation curve as shown in FIG. 4.

In order to effect more uniform charging, it is considered most preferable for the photosensitive member surface to be charged by a discharge electric current kept in a steady state where it rests at a constant value as shown in FIG. 4.

Compared with a stable steady state, the electric current flows from the charging member in a large quantity ($I_o$) at the initial stage where a voltage has been applied. Namely, the charging member is considered to be in a state of a low resistance at the initial stage where the electric current has begun to flow. In other words, at the initial stage where the electric current has begun to flow, it stands as if the photosensitive member was subjected to charging with a conductor having a low resistance, such as a metal. Through studies having been made by us, it has been found that any uniform charged surface is not obtainable if the photosensitive member is subjected to charging with a metal.

More specifically, we considered it ideal that, in order to perform uniform charging, the discharge electric current of the charging member should come to be in a steady state ($I_1$) instantaneously at the time a certain point of the charging member surface has reached a discharge region to the photosensitive member. Accordingly, we took note of the time constant $\tau$ as a standard of changes in an attenuation curve of the discharge electric current of the charging member.

The relationship between the time constant $\tau$ of a charging member and the time the charging member passes a discharge region is disclosed in Japanese Patent Application Laid-Open No. 10-26866. However, the phenomenon called "local uneven charging" that is given as a problem to be solved by the invention in that Japanese Patent Application Laid-Open No. 10-26866 differs from the phenomenon called "excessive-charging uneven potential" that is the problem the present invention aims at solving. For example, Japanese Patent Application Laid-Open No. 10-26866 states that the phenomenon called "local uneven charging" tends to occur with an increase in the surface movement speed of the charging member. However, as a result of our repeated extensive studies, the phenomenon "excessive-charging uneven potential" which is the problem the present invention aims at solving was found to tend to occur more when the surface movement speed of the charging member is lower, conversely to what is stated in Japanese Patent Application Laid-Open No. 10-26866.

In addition, in the above Japanese Patent Application Laid-Open No. 10-26866, the time constant $\tau$ is determined by calculation from the product of electrostatic capacitance C and resistivity R. When the time constant τ is calculated by the method disclosed in this Japanese Patent Application Laid-Open No. 10-26866, the conducting member of the present invention and other different conducting members were found to have similar values of time constant τ. However, as a result of evaluation and studies on the "excessive-charging uneven potential" of these both conducting members, the conducting member of the present invention did not cause any excessive-charging uneven potential, but other conducting members having similar time constants caused excessive-charging uneven potential.

As the result of our repeated extensive studies, even conducting members having similar time constants τ according to the time constant calculation method disclosed in the above Japanese Patent Application Laid-Open No. 10-26866 were found to show different time constants τ when the time constant τ was calculated according to an approximation equation on the basis of waveform data of electric-current values, and thus it has become possible to distinguish denotes a cylindrical electrode (metal roller); 12 denotes a fixed resistor; 13 denotes the recorder; and S3 denotes a power source.

Figure 5:
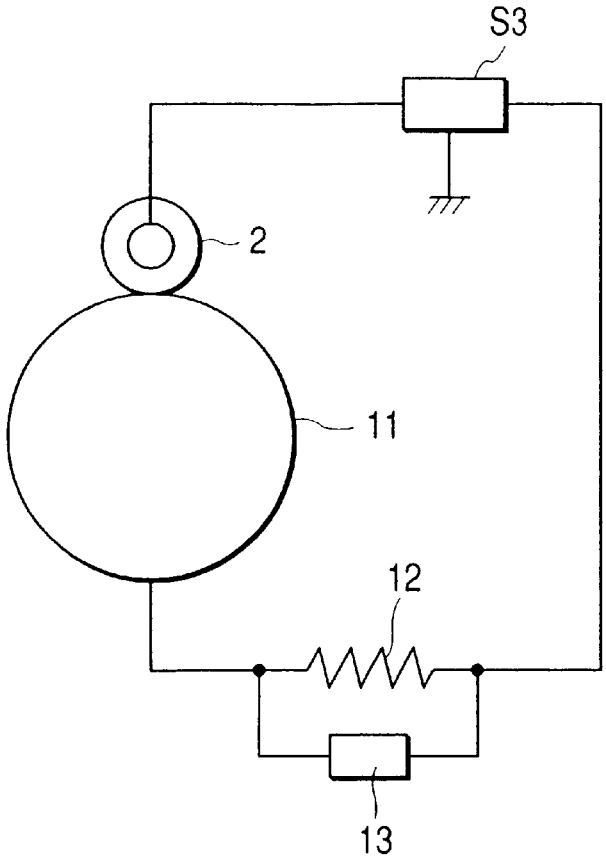
FIG. 5 is a schematic illustration of a measuring instrument for the value of electric current of a charging member.

In particular, the difference in time constant τ between the conducting member of the present invention and other different conducting members was found to be clearly distinguishable when in the apparatus as shown in FIG. 5 where the DC voltage applied to the conducting member is represented by Vo, the value of DC voltage Vo is set to be a high value not lower than that of the discharge-starting voltage $V_{TH}$ applied when the charging object member is charged.

Since the conducting member stands in contact with the charging object member, the resistance of the conducting member at the time of actual charging involves electrical contact resistance, and also depends on the area of contact of the conducting member with the charging object member and on how the conducting member deforms. Hence, with regard to the electric-current values of the conducting member, electric-current values measured in a state where the contact of the conducting member with the electrode is brought into the same state as that of the charging object member reflect the state held at the time of actual charging. Accordingly, in the present invention, it is so designed that the electric-current values of the conducting member which are close to those at the time of actual charging are determined by the electric-current measuring method as shown in FIG. 5.

In addition, since the excessive-charging uneven potential occurs remarkably in a low-temperature and low-humidity environment, it is preferable that the electric-current values of the conducting member are measured in such a low-temperature and low-humidity environment (e.g., temperature: 15° C.; humidity: 10% RH) and the time constant τ is determined from the electric-current values thus obtained.

The selection of the value of the time constant τ of electric current of the conducting member to be 1.0 or smaller when calculated by the measuring method of the present invention has proved to be very effective for preventing the "excessive-charging uneven potential" from occurring.

In the present invention, where the surface of the conducting member has a coefficient of static friction of 1.0 or lower, the surface of the conducting member may hardly become contaminated, so that any faulty charging due to contamination of the conducting member may hardly occur. This acts cooperatively with the constitution of the conducting member of the present invention, and very good images can be obtained. In particular, this is effective for enabling many-sheet printing in electrophotographic apparatus employing what is called a cleaning-at-development (or cleanerless) system, in which, as shown in FIG. 1, any dependent cleaning means is provided and the toner having remained on the photosensitive member after transfer is collected by a developing means.

In the present invention, the conducting member may have a surface roughness of 10 μm or smaller as the ten-point average surface roughness Rz prescribed in JIS B0601. This enables prevention of uneven charging due to any unevenness of the conducting member surface, and acts cooperatively with the constitution of the conducting member of the present invention, so that very good images can be obtained.

The electrophotographic apparatus of the present invention is constructed as outlined below.

(1) Example of Electrophotographic Apparatus

FIG. 1 is a schematic illustration of the construction of the electrophotographic apparatus of the present invention. The electrophotographic apparatus of this example is an apparatus of a reverse development system and of a cleaning-at-development (or cleanerless) system, employing transfer type electrophotography.

Reference numeral 1 denotes a rotating drum type electrophotographic photosensitive member, which is rotatingly driven in the direction of an arrow at a stated peripheral speed (process speed).

Reference numeral 2 denotes a charging roller (the conducting member of the present invention) serving as a means for charging the photosensitive member, which is kept in contact with the photosensitive member 1 under a stated pressure. In this example, the charging roller 2 is driven, and is rotated at a speed equal to the photosensitive member 1. A stated DC voltage (in this case, set at −1,300 V) is applied to this charging roller 2 from a charging bias-applying power source S1, and thus the surface of the photosensitive member is uniformly charged to a stated polarity and potential (set at a dark-area potential of −700 V) by a contact charging and DC charging system.

Reference numeral 3 denotes an exposure means, which is, e.g., a laser beam scanner. Of the photosensitive member 1, the surface to be uniformly charged is exposed to light L corresponding to the intended image information, which is exposed through an exposure means 3, so that the potential at exposed light areas (set at a light-area potential of −120 V) of the charged surface of the photosensitive member is lowered (attenuates) selectively and an electrostatic latent image is formed.

Reference numeral 4 denotes a reverse developing means, where a toner (a negative toner) standing charged (development bias: −350 V) to the same polarity as the charge polarity of the photosensitive member is made to adhere selectively to the exposed light areas of the electrostatic latent image on the photosensitive member surface to render the electrostatic latent image visible as a toner image. In FIG. 1, reference numeral 4*a* denotes a developing roller; 4*b* denotes a toner feed roller; and 4*c* denotes a toner layer thickness regulation member.

Reference numeral 5 denotes a transfer roller as a transfer means, which is kept in contact with the photosensitive member under a stated pressure to form a transfer nip, and is rotated in the forward direction of the rotation of the photosensitive member at a peripheral speed substantially equal to the peripheral speed of the rotation of the photosensitive member. Also, a transfer voltage having a polarity opposite to the charge polarity of the toner is applied from a transfer bias-applying power source S2. A transfer medium P is fed at a stated controlled timing from a paper feed mechanism section (not shown) to the transfer nip, and is charged to a polarity opposite to the charge polarity of the toner by means of a transfer roller 5, whereby the toner image on the surface side of the photosensitive member 1 is electrostatically transferred to the surface side of the transfer medium P.

The transfer medium P to which the toner image has been transferred at the transfer nip is separated from the surface of the rotating photosensitive member, and is guided into a toner image fixing means (not shown), where the toner image is subjected to fixing. Then the image-fixed transfer medium is outputted as an image-formed matter. In the case of a double-side image-forming mode or a multiple-image-forming mode, this image-formed matter is guided into a recirculation delivery mechanism (not shown) and is again guided to the transfer nip.

Residues on the photosensitive member, such as transfer residual toner, are charged by the charging roller 2 to the same polarity as the charge polarity of the photosensitive member.

Then, the transfer residual toner is passed through the exposure zone to reach the developing means 4, where it is electrostatically collected in the developing means to accomplish the cleaning-at-development (cleanerless cleaning).

In this example, the electrophotographic photosensitive member 1, the charging roller 2 and the developing means 4 may be supported as one unit to constitute a process cartridge 6, which is detachably mountable to the main body of the electrophotographic apparatus. Here, the developing means 4 may be set as a separate assembly.

(2) Electrophotographic Photosensitive Member

The electrophotographic photosensitive member 1, which is an image-bearing member used in the electrophotographic apparatus of the present invention, is constituted as described below with reference to FIG. 6.

A photosensitive layer 1*b* is provided on a conductive support 1*a*.

As the support 1*a*, a hollow cylinder, a sheet, or a film, made of a metal, such as aluminum or stainless steel, paper or plastic, may be used. Also, these hollow cylinder, sheet and film may optionally have a conductive polymer layer or a resin layer containing conductive particles such as tin oxide particles, titanium oxide particles or silver particles.

Figure 6:
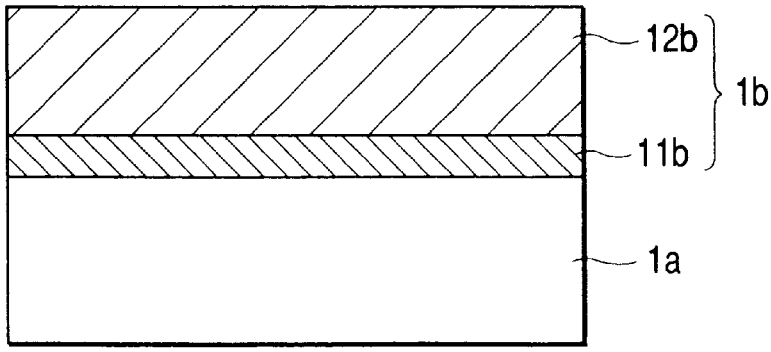
FIG. 6 is a layer cross-sectional view of an electrophotographic photosensitive member.
Figure 7:
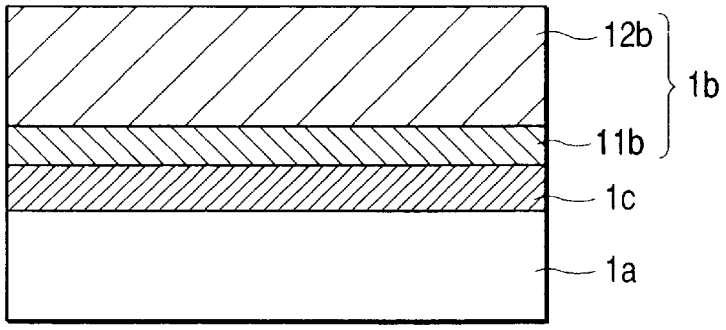
FIG. 7 is a layer cross-sectional view of another electrophotographic photosensitive member.

As also shown in FIG. 6, the photosensitive layer 1*b* is so made up that at least a charge generation layer 11*b* containing a charge-generating material and a charge transport layer 12*b* containing a charge-transporting material are successively superposed on the support 1*a*. Here, as shown in FIG. 7, a subbing layer 1*c* functioning as a barrier and an adhesion layer may be provided between the support 1*a* and the photosensitive layer 1*b* (charge generation layer 11*b*).

The subbing layer is formed in order to, e.g., improve adhesion of the photosensitive layer, improve coating properties, protect the support, cover any defects present on the support, improve the injection of electric charges from the support and protect the photosensitive layer from electrical breakdown. It may preferably have a thickness of from 0.2 to 2 $\mu$m.

As the charge-generating material, usable are pyrylium or thiopyrylium dyes, phthalocyanine pigments, anthanthrone pigments, dibenzopyrenequinone pigments, pyranthrone pigments, azo pigments, indigo pigments, quinacridone pigments, asymmetric quinocyanine, and quinocyanine.

As the charge-transporting material, usable are hydrazone compounds, pyrazoline compounds, styryl compounds, oxazole compounds, thiazole compounds, triarylmethane compounds and polyarylalkane compounds.

The charge generation layer 11*b* may be formed by coating a dispersion prepared by thoroughly dispersing the charge-generating material together with a binder resin in a 0.2- to 4-fold amount by weight, by means of a homogenizer, ultrasonic waves, a ball mill, a vibrating ball mill, a sand mill, an attritor, a roll mill or a high-pressure impact dispersion machine, followed by drying. It may have a thickness of 5 $\mu$m or smaller, and particularly preferably in the range of from 0.01 to 1 $\mu$m.

The charge transport layer 12*b* may be formed by coating a solution prepared by dissolving the charge-transporting material and a binder resin in a solvent, followed by drying. The charge-transporting material and the binder resin may preferably be mixed in a proportion of from 2:1 to 1:2 in weight ratio. As the solvent, usable are ketones such as acetone and methyl ethyl ketone, esters such as methyl acetate and ethyl acetate, aromatic hydrocarbons such as toluene and xylene, and chlorine type hydrocarbons such as chlorobenzene, chloroform and carbon tetrachloride. When this solution is coated, any of coating processes as exemplified by dip coating, spray coating and spin coating may be used. The drying may be carried out by blow drying or drying at rest, preferably at a temperature ranging from 10° C. to 200° C., and more preferably from 20° C. to 150° C., for a time preferably from 5 minutes to 5 hours, and more preferably from 10 minutes to 2 hours.

The charge transport layer formed may have a thickness of from 12 to 40 $\mu$m, preferably from 12 to 23 $\mu$m, and particularly preferably from 12 to 18 $\mu$m. An electrophotographic photosensitive member whose charge transport layer has a thickness larger than 40 $\mu$m tends to cause microscopic blank areas and coarseness on images, which are considered to be due to the excessive-charging uneven potential, in a low-temperature and low-humidity environment when the contact charging is carried out under application of only DC voltage. Also, in a thickness smaller than 12 $\mu$m, the photosensitive member tends to undergo a great potential variation due to abrasion. For example, when abraded in the like amount, a photosensitive member having a thin charge transport layer may undergo a greater change in volume and correspondingly a greater potential variation, than a photosensitive member having a thick charge transport layer. Especially in the case of the DC charging system, this is not preferable in view of charge potential stability and running performance because the discharge-starting voltage $V_{TH}$ may change as a result of abrasion.

Incidentally, the thickness of these layers can be measured by observing a cross section of the electrophotographic photosensitive member on a transmission electron microscope.

The binder resin used to form the charge transport layer may preferably be a resin selected from acrylic resins, styrene resins, polyesters, polyarylate resins (such as polycarbonate resins), polysulfone resins, polyphenylene oxide resins, epoxy resins, polyurethane resins, alkyd resins and unsaturated resins. Particularly preferred resins may include polymethyl methacrylate, polystyrene, a styrene-acrylonitrile copolymer, polycarbonate resins, diallylphthalate resins and polyarylate resins.

The charge generation layer or charge transport layer may also be incorporated with various additives such as an antioxidant, an ultraviolet light absorber, a lubricant and so forth.

The electrophotographic photosensitive member used in the present invention may be made to have a rough surface.

As methods therefor, usable are mechanical abrasion making use of an abrasive or carried out by sand blasting, and besides a method in which electrically inert particles such as metal oxide particles or resin powder particles are dispersed in the surface layer of the photosensitive member.

(3) Charging Roller (Conducting Member)

The time constant $\tau$ referred to in the present application invention depends on various factors such as the materials constituting the conducting member, the weight ratio of the materials used, and the mixed state of the materials used. What is important in the present invention is that the time constant $\tau$ is 0.1 second or shorter. There are no particular limitations on the manner by which it is accomplished.

In the present invention, the time constant T may preferably be 0.05 second or shorter, and particularly preferably 0.00001 second or longer. If the time constant $\tau$ is longer than 0.1 second, the remarkable effect of the present invention can not be obtained. If it is shorter than 0.00001 second, and when pinholes are present in the electrophotographic photosensitive member, the potential may drop at the part of the pinholes of course and also at the part around them, and images looking blurred around pinholes tend to be formed especially in halftone images.

Figure 2:
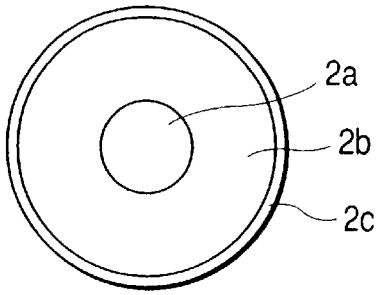
FIG. 2 is a schematic illustration of a charging roller.

The conducting member has, e.g., the shape of a roller as shown in FIG. 2, and is constituted of a conductive support 2*a* and as covering layers an elastic layer 2*b* integrally formed on its periphery and a surface layer 2*c* formed on the periphery of the elastic layer 2*b*.

Figure 3A:
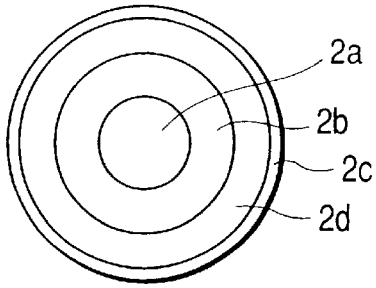
FIGS. 3A and 3B are schematic illustrations of different charging rollers.
Figure 3B:
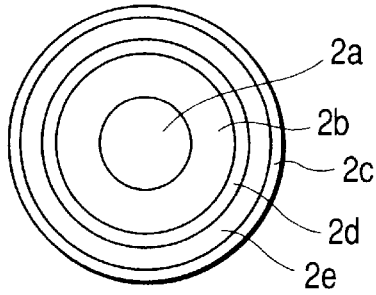

Another constitution of the conducting member (charging roller) of the present invention is shown in FIGS. 3A and 3B. As shown in FIG. 3A, the conducting member may have three layers consisting of an elastic layer 2*b*, a resistance layer 2*d* and a surface layer 2*c* or, as shown in FIG. 3B, may be so made up that at least four layers are formed on the conductive support 2*a,* which are provided with a second resistance layer 2*e* between the resistance layer 2*d* and the surface layer 2*c*.

As the conductive support 2*a* used in the present invention, a round rod of a metallic material such as iron, copper, stainless steel, aluminum or nickel may be used. The surface of any of these metals may further be plated for the purpose of anti-corrosion or impartment of resistance to scratches, but must not damage conductivity.

In the charging roller 2, the elastic layer 2*b* is endowed with appropriate conductivity and elasticity in order to supply electricity to the photosensitive member 1 serving as the charging object member and to ensure a good uniform close contact of the charging roller 2 with the photosensitive member. Also, in order to ensure a good uniform close contact of the charging roller 2 with the photosensitive member, the charging roller may also preferably be so abraded as to be formed into what is called a crown, which is a shape having the largest diameter at the middle and diameters made smaller toward the both ends. Since a charging roller 2 commonly used is brought into contact with the photosensitive member 1 under the application of a stated pressure on both ends of the support 2*a*, the pressure is low at the middle and is larger toward the both ends. Hence, there is no problem as long as the charging roller 2 has a sufficient straightness. If, however, it has an insufficient straightness, it may cause an uneven density in images between those corresponding to the middle and the both ends. It is formed into the crown in order to prevent this.

The elastic layer 2*b* may have a conductivity adjusted to below $10^{10}$ Ω·cm by appropriately adding in an elastic material such as rubber a conducting agent having an electron-conducting mechanism, such as carbon black, graphite or a conductive metal oxide, and a conducting agent having an ion-conducting mechanism, such as an alkali metal salt or a quaternary ammonium salt. Specific materials for the elastic layer 2*b* may include, e.g., natural rubbers, synthetic rubbers such as ethylene-propylene diene rubber (EPDM), styrene-butadiene rubber (SBR), silicone rubber, urethane rubber, epichlorohydrin rubber, isoprene rubber (IR), butadiene rubber (BR), nitrile-butadiene rubber (NBR) and chloroprene rubber (CR), and may further include polyamide resins, polyurethane resins and silicone resins. In particular, in order to achieve the electrical properties required in the present invention, medium-resistance polar rubbers (e.g., epichlorohydrin rubber, NBR, CR and urethane rubber) or polyurethane resins may preferably be used as elastic materials. These polar rubbers and polyurethane resins are considered to have a conductivity, though slightly, as the water content or impurities in rubber or resin act(s) as a carrier, and the conducting mechanism of these are considered to be ion conduction. However, conducting members (charging members) obtained by forming the elastic layer without adding the conducting agent at all to any of these polar rubbers and polyurethane resins have a high resistivity, which is as high as $10^{10}$ Ω·cm or above in a low-temperature and low-humidity environment. Hence, it becomes necessary to apply a high voltage to such conducting members.

Accordingly, the above conducting agent having an electron-conducting mechanism or conducting agent having an ion-conducting mechanism may preferably be added to adjust the conductivity so that the conducting member can have a resistivity below $10^{10}$ Ω·cm and also the time constant $\tau$ of electric current of the conducting member can be 0.1 second or shorter. As a result of our repeated extensive studies, the time constant $\tau$ of electric current of the conducting member proved to tend to become smaller when a conducting agent having an ion-conducting mechanism is added to adjust the resistivity. The conducting agent having an ion-conducting mechanism, however, has a small effect of lowering resistivity, which effect is small especially in a low-temperature and low-humidity environment. Accordingly, in combination with the addition of the conducting agent having an ion-conducting mechanism, the conducting agent having an electron-conducting mechanism may auxiliarily be added to adjust the resistivity.

As the conducting agent having an electron-conducting mechanism, it has tended to be considered preferable to add a deformable layer compound or whiskers, e.g., graphite, to form the elastic layer.

Foams obtained by blowing these elastic materials may also be used in the elastic layer 2*b*.

The resistance layer 2*d* shown in FIG. 3 is formed at a position adjoining the elastic layer, and hence it is provided in order to prevent a softening oil, a plasticizer or the like contained in the elastic layer, from bleeding out to the conducting member surface, or to adjust electrical resistance of the whole conducting member.

Materials constituting the resistance layer used in the present invention may include, e.g., epichlorohydrin rubber, NBR, polyolefin type thermoplastic elastomers, urethane type thermoplastic elastomers, polystyrene type thermoplastic elastomers, fluorine rubber type thermoplastic elastomers, polyester type thermoplastic elastomers, polyamide type thermoplastic elastomers, polybutadiene type thermoplastic elastomers, ethylene-vinyl acetate type thermoplastic elastomers, polyvinyl chloride type thermoplastic elastomers and chlorinated polyethylene type thermoplastic elastomers. Any of these materials may be used alone, may be a mixture of two or more types, or may form a copolymer.

The resistance layer 2*d* used in the present invention must have conducting properties or semiconducting properties. To exhibit conducting or semiconducting properties, various conducting agents having an electron-conducting mechanism (such as conductive carbon, graphite, conductive metal oxides, and copper, aluminum, nickel and iron powders) or conducting agents having an ion-conducting mechanism (such as alkali metal salts and ammonium salts) may appropriately be used. In this case, in order to attain the desired electrical resistance, such various conducting agents may be used in combination of two or more types. However, taking account of environmental variations and photosensitive member contamination, the conducting agents having an electron-conducting mechanism are preferred.

The resistance layer may preferably have a resistivity of from $10^4$ to $10^{12}$ Ω·cm. In order to control the time constant τ to 0.1 second or shorter, it may preferably have a resistivity $10^{-2}$ to $10^5$ times that of the elastic layer.

The resistance layer may also preferably have a thickness of from 5 to 1,000 μm.

In the present invention, as mentioned previously, the surface of the conducting member may preferably have a coefficient of static friction of 1.0 or lower. In order to achieve such characteristics, it is preferable to select as a material a binder resin having a coefficient of static friction of 0.50 or lower.

In the following, the coefficient of static friction of the surface (surface layer) of the conducting member is represented by μs, and the coefficient of static friction of the binder resin of the surface layer is represented by $\mu s_B$.

In the present invention, in the selection of materials for the surface layer, the coefficient of static friction $\mu s_B$ of the binder resin is measured in the following way: A coating film of the binder resin is formed on an aluminum sheet to obtain a sample sheet. The coefficient of static friction $\mu s_B$ of the binder resin of the conducting-member surface layer is measured with a static-friction coefficient measuring instrument, HEIDON TRIBOGEARMUSE TYPE 941 (manufactured by Shinto Kagaku K.K.).

A conducting agent and other additive are incorporated in the material having a coefficient of static friction $\mu s_B$ of 0.50 or lower as measured by this method, to form the surface layer of the conducting member. Then, the conducting member is so material-designed that the surface has a coefficient of static friction μs of 1.0 or lower as the conducting member.

Figure 8:
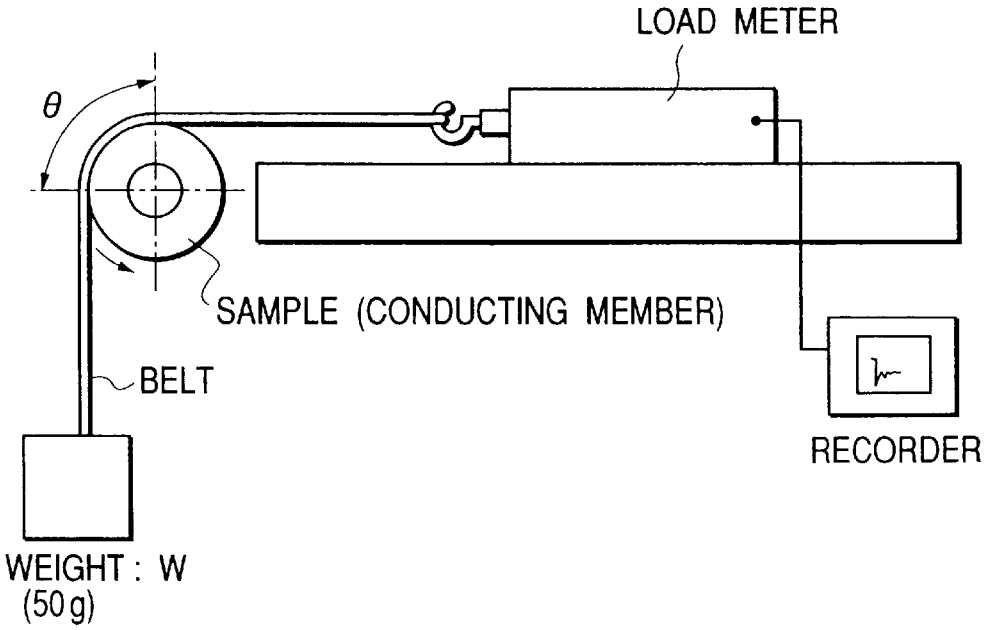
FIG. 8 is a schematic illustration of a measuring instrument for the coefficient of friction of a charging roller surface.

The measurement of the coefficient of static friction μs of the conducting member surface is outlined in FIG. 8. This measuring method is a method suited when the measuring object has the shape of a roller, and is a method which conforms to the Euler's belt equation. According to this method, a belt (20 μm thick, 30 mm wide and 180 mm long) brought into contact with the measuring-object conducting member at a stated angle (θ) is connected with a measurement section (a load meter) at its one end and with a weight W at the other end. When in this state the conducting member is rotated in and at stated direction and speed, the coefficient of friction (μ) is determined by the following equation where the force measured at the measurement section is represented by F (g) and the weight of the weight is denoted by W (g):

$$\mu=(1/\theta)\ln(F/W).$$

Figure 9:
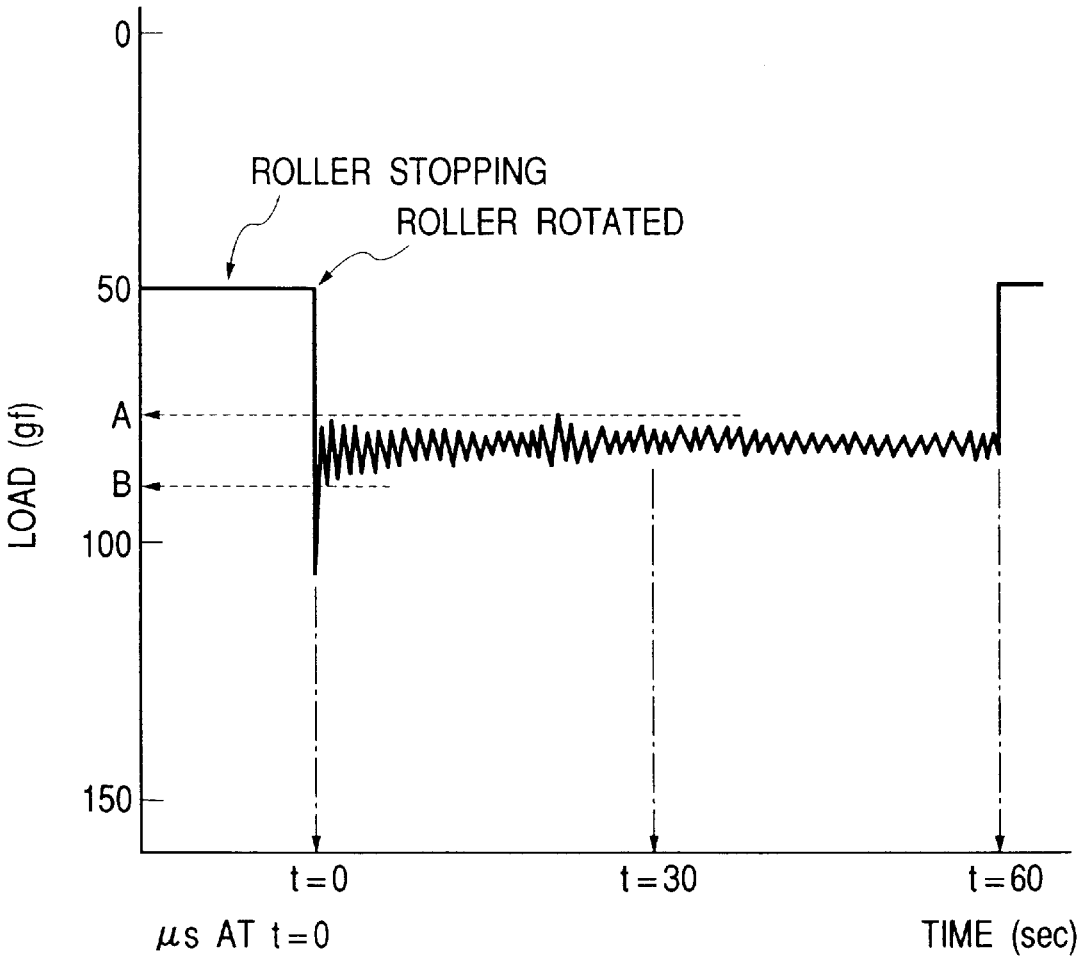
FIG. 9 is an example of a chart obtained by the friction coefficient measuring instrument.

An example of a chart obtained by this measuring method is shown in FIG. 9. Here, it is seen that the value obtained immediately after the conducting member is rotated indicates the force necessary to start the rotation and the value after that indicates the force necessary to continue the rotation. Hence, the force at a rotation start point (i.e., the point of time, τ=0 second) can be said to be the static frictional force and also the force at an arbitrary time of 0<t (second)≦60 can be said to be the dynamic frictional force at the arbitrary time.

Therefore, the coefficient of static friction can be determined by:

$$\mu s=(1/\theta)\ln(F_{<t=0>}/W).$$

In this measuring method, coefficients of friction of various substances can be determined by forming the belt surface (the side coming into contact with the conducting member) using stated materials (e.g., those with which the photosensitive-member outermost layer or developer is coated by a suitable means, or standard substances such as stainless steel). Namely, it would be more preferable if materials of the contacting surfaces, the rotational speed, the load and so forth are adjusted to process conditions of actual machines, but it has been found that, as the result of comparison and studies made by measuring the coefficient of friction between the conducting member and the photosensitive member and measuring the coefficient of friction between the conducting member and the stainless steel, the coefficient of friction to stainless steel may also be used. More specifically, it is generally expressed as (coefficient of friction between conducting member and photosensitive member)=K×(coefficient of friction between conducting member and stainless steel). Here, K represents a numerical value that depends on the materials or state of the photosensitive member, and comes to be substantially a constant value as long as the materials and surface state of the photosensitive member are the same, but may change if they differ more or less.

Hence, it is desirable for the types and mixing proportion of materials, the production conditions, the surface physical properties, and so forth, to be brought into agreement with those of an actual system. However, it is very troublesome to do so and the coefficient of friction between the conducting member and the photosensitive member and the coefficient of friction between the conducting member and stainless steel have the correlation as described above. Accordingly, in the present invention, for the sake of convenience, the coefficient of friction is measured for stainless steel (its surface has a ten-point average roughness Rz of 5 μm or smaller) and under conditions of a rotational speed of 100 rpm and a load of 50 g.

As the result of our repeated extensive studies, it has been found that controlling the conducting member surface to have the physical properties as described above (μs≦1.0) makes the toner hardly adhere to the conducting member surface and hence enables uniform charging even when printed on a large number of sheets in total and makes no image fog occur. In addition, image fog does not occur even when printing on a large number of sheets in total and even in a low-temperature and low-humidity environment where image fog due to adhesion of toner tends to occur. If the coefficient of static friction $\mu s$ is larger than 1.0, the conducting-member surface has so small a releasability as to tend to cause adhesion of transfer residual toner, and this may cause deterioration of image quality. This tends to cause the deterioration of image quality especially in a low-temperature and low-humidity environment. Hence, the feature that the coefficient of static friction $\mu s$ is 1.0 or lower in addition to the constitution of the present invention is effective in an image-forming apparatus employing the cleaning-at-development system (cleanerless system).

The surface layer 2*c* also constitutes the surface of the conducting member, and comes into contact with the charging-object-member photosensitive member. Hence, it must not be constituted of a material that may contaminate the photosensitive member.

Binder resin materials of the surface layer 2*c* for making the conducting member exhibit the features of the present invention may include fluorine resins, polyamide resins, acrylic resins, polyurethane resins, silicone resins, butyral resins, styrene-ethylene/butylene-olefin copolymers (SEBC) and olefin-ethylene/butylene-olefin copolymers (CEBC).

For the purpose of making these resins have a low coefficient of static friction, a solid lubricant such as graphite, mica, molybdenum disulfide or fluorine resin powder, fluorine surfactant, wax, silicone oil or the like may be added.

In the surface layer, taking account of environmental variations and photosensitive-member contamination, conducting agents having an electron-conducting mechanism (such as conductive carbon, graphite, conductive tin oxide, conductive titanium oxide, and copper, aluminum, nickel and iron powders) may appropriately be used. In this case, in order to attain the desired electrical resistance, such various conducting agents may be used in combination of two or more types.

The surface layer may preferably have a resistivity of from $10^4$ to $10^{15}$ Ω·cm. In order to control the time constant $\tau$ to 0.1 second or shorter, it may preferably have a resistivity $10^{-2}$ to $10^9$ times that of the elastic layer.

The surface layer may also preferably have a thickness of from 1 to 500 $\mu$m, and particularly from 1 to 50 $\mu$m.

In the present invention, as mentioned previously, the conducting member may preferably have a ten-point average surface roughness Rz of 10 $\mu$m or smaller. Where the conducting member of the present invention is used, any unevenness of its surface may cause a delicately uneven charging if the conducting member has a rough surface, to cause faulty images consequently. There is also a possibility of attacking (e.g., abrading) the photosensitive-member surface. Hence, it is more preferred for the conducting member to have a smoother surface, and the conducting member may preferably have a ten-point average surface roughness Rz of 10 $\mu$m or smaller, and more preferably 4 $\mu$m or smaller.

(4) Developer (Toner)

There are no particular limitations on the toner used in the present invention, and any known toners may be used. In order to reduce the quantity of toner adhering to the charging roller (conducting member), it is preferable to use spherical toner particles, which have a good transfer efficiency.

In the electrophotographic apparatus employing the cleaning-at-development system, it is also preferable to use spherical toner particles, which have a good transfer efficiency. As the spherical toner particles, it is preferable to use, e.g., toner particles formed by polymerization.

EXAMPLES

The present invention will be described below in greater detail by giving working examples. In the following examples, "part(s)" refers to "parts by weight".

Example 1

Preparation of Conducting Member

A charging roller as the conducting member of the present invention was prepared in the following way.

| | |
|---|---|
| Epichlorohydrin rubber (three-dimensional copolymer) | 100 parts |
| Quatemary ammonium salt | 2 parts |
| Calcium carbonate | 30 parts |
| Zinc oxide | 5 parts |
| Fatty acid | 2 parts |

The above materials were kneaded for 10 minutes by means of an internal mixer controlled to 60° C. Thereafter, 15 parts by weight of an ether-ester type plasticizer was added, based on 100 parts by weight of the epichlorohydrin rubber, followed by further kneading for 20 minutes by means of the internal mixer, having been cooled to 20° C., to prepare a material compound. To this compound, 1 part of sulfur as a vulcanizing agent and 1 part of Nocceler DM (trade name; available from Ouchi-Shinko Chemical Co., Ltd.) and 0.5 part of Nocceler TS as vulcanizing accelerators were added, based on 100 parts of the material rubber epichlorohydrin rubber, followed by kneading for 10 minutes by means of a twin-roll mill cooled to 20° C. The resultant compound was molded by means of an extruder, which was so extruded around a stainless steel mandrel (support) of 6 mm in diameter as to be in the shape of a roller. After the heating-and-vulcanizing molding, the molded product was subjected to abrasion so as to have an outer diameter of 12 mm, thus forming an elastic layer on the support. The elastic layer had a resistivity of $4\times10^6$ Ω·cm.

On this elastic layer, a surface layer as shown below was formed by coating.

As a material for the surface layer 2*c*, a fluorine resin copolymer obtained by copolymerizing a fluoroolefin (tetrafluoride type), a hydroxyalkyl vinyl ether and a carboxylic acid vinyl ester was used. To 100 parts of its ethanol solution (solid content: 50% by weight), 5 parts of an isocyanate (HDI) and 45 parts of conductive tin oxide were added to prepare a coating fluid. Using the coating fluid, it was coated by dip coating to form a surface layer of 10 $\mu$m thick, thus obtaining a roller-shaped conducting member (charging roller). The surface layer had a resistivity of $3\times10^{14}$ Ω·cm.

Production of Electrophotographic Photosensitive Member

An aluminum cylinder of 30 mm in outer diameter, 28.5 mm in inner diameter and 260 mm in length was used as the conductive support. On this support, a 5% methanol solution of polyamide (trade name: AMILAN CM8000; available from Toray Industries, Inc.) was coated by dip coating to form a subbing layer of 0.40 $\mu$m thick.

Next, 10 parts of a disazo pigment having the following structural formula:

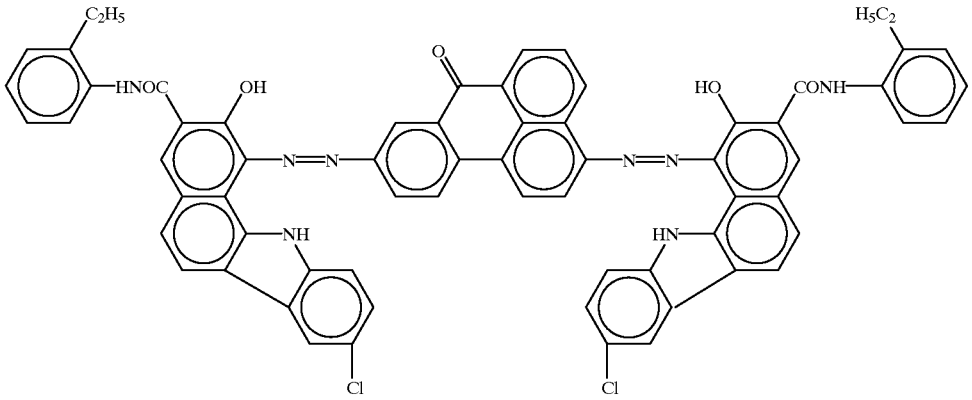

and 10 parts of polyvinyl butyral (trade name: S-LEC BLS; available from Sekisui Chemical Co., Ltd.) and also 100 parts of cyclohexanone were dispersed for 20 hours by means of a sand mill making use of glass beads of 1 mm diameter. To the resultant dispersion, 100 parts of methyl ethyl ketone was added, and the coating fluid obtained was coated on the subbing layer to form a charge generation layer of 0.20 μm thick.

Next, 10 parts of a triphenylamine compound having the following structural formula:

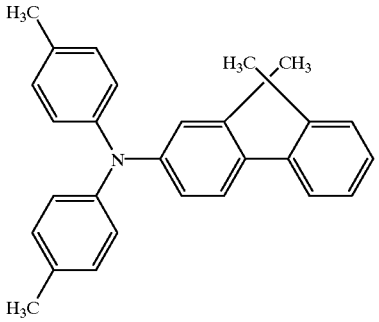

and 10 parts of bisphenol-Z polycarbonate having the following structural formula (viscosity-average molecular weight: 23,000) was dissolved in 100 parts of monochlorobenzene.

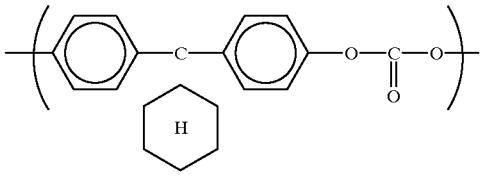

The solution obtained was coated on the charge generation layer, followed by hot-air drying at 100° C. for 1 hour to form a charge transport layer of 25 μm thick. Thus, an electrophotographic photosensitive member of Example 1 was produced.

Measurement of Coefficient of Static Friction $\mu s_B$ of Charging Roller Surface Layer Material The same binder resin as that used to form the surface layer was made into a coating fluid, used as a clear coating fluid, which was then coated on an aluminum sheet to prepare a sample sheet for measuring the coefficient of static friction ($\mu s_B$).

The coefficient of static friction of this sample sheet was measured with the static-friction coefficient measuring instrument, HEIDON TRIBOGEARMUSE TYPE 941 (manufactured by Shinto Kagaku K.K.). The coefficient of static friction psB was found as an average value of measurements at arbitrary five spots on the sample sheet. The coefficient of static friction of the binder resin of the surface layer in the present Example was 0.12.

Measurement of Coefficient of Static Friction μs of Charging Roller Surface

The coefficient of static friction us was measured as described previously, using the measuring instrument as shown in FIG. 8. As a result, the coefficient of static friction μsof the charging roller surface in the present Example was 0.27.

Measurement of charging roller surface roughness:

The ten-point average surface roughness Rz of the charging roller surface was 2.9 μm.

Measurement of electric current of charging roller, and calculation of time constant τ:

The electric current of the conducting member (charging roller) was measured with the instrument shown in FIG. 5, in an environment of 15° C. temperature and 10% humidity. This instrument was so set up that the pressure of the charging roller against the cylindrical electrode and so forth were all set in the same manner as those in FIG. 1 except that the drum type photosensitive member in the electrophotographic apparatus shown in FIG. 1 was replaced with the conductive cylindrical electrode having the like shape. A DC voltage (−1,000 V) was applied to the charging roller from an external power source, and the values of electric current flowing there were read into the recorder, and the waveform data thereof were expressed by the following approximation equation:

$$I = Io \exp(-t/\tau)$$

to determine the time constant τ of electric current of the charging roller. As the result, the time constant τ of electric current of the charging roller was:

$$\tau = 0.021 \text{ [sec]}.$$

Therefore, the τ in Example 1 satisfies $\tau \leqq 0.1$ [sec].

Image Evaluation When Only DC Voltage is Applied to Charging Roller

The charging roller obtained as described above was set in the electrophotographic apparatus shown in FIG. 1, and images were reproduced in environments of environment 1 (temperature 23° C., humidity 55%), environment 2 (temperature 32.5° C., humidity 80%) and environment 3 (temperature 15° C., humidity 10%). Images were visually evaluated on whether or not any partial blank areas and coarse images occurred which were due to the excessive-charging uneven potential of the charging roller. Results obtained are shown in Table 1. Here, images were reproduced while changing the applied voltage for each environment in such a way that the dark-area potential VD was kept at about −700 V.

In Table 1, "AA" indicates that the images obtained are very good; "A" indicates that they are good; "B" indicates that uneven density and coarse images are a little seen in halftone images; and "C" indicates that many partial blank areas are seen in halftone images.

Incidentally, spherical toner particles (average particle diameter: 8 μm) produced by suspension polymerization were used as the toner.

Evaluation on Image Fog Due to Toner Adhesion Onto Charging Roller

The charging roller obtained as describe above was set in the electrophotographic apparatus shown in FIG. 1, and many-sheet image reproduction running tests were made in environments of environment 1 (23° C. temperature, 55% humidity), environment 2 (32.5° C. temperature, 80% humidity) and environment 3 (15° C. temperature, 10% humidity). Images obtained were visually observed to make evaluation on whether or not the toner adhered onto the charging roller and any fog caused by it occurred on printing paper. Results obtained are shown in Table 2.

In Table 2, "AA" indicates that the images obtained are very good; "A"indicates that they are good; "B"indicates that uneven density corresponding to rotational periods of the charging roller is a little seen in halftone images; and "C"indicates that fog corresponding to rotational periods of the charging roller is seen.

As the result, good images were obtainable from the beginning in all the environments. Even after image reproduction on 10,000 sheets, images were obtainable which were almost free of any change from those formed at the initial stage.

Incidentally, spherical toner particles (average particle diameter: 8 μm) produced by suspension polymerization were used as the toner.

Example 2

A charging roller and an electrophotographic photosensitive member were produced in the same manner as in Example 1 except that the charging roller as the conducting member was constituted as described below.

| | |
|---|---|
| NBR (nitrile-butadiene rubber) | 100 parts |
| Lithium salt | 1.5 parts |
| Ester type plasticizer | 25 parts |
| Calcium carbonate | 30 parts |
| Zinc oxide | 5 parts |
| Fatty acid | 2 parts |

The above materials were kneaded for 10 minutes by means of an internal mixer controlled to 60° C., and thereafter further kneaded for 20 minutes by means of the internal mixer, having been cooled to 20° C., to prepare a material compound. To this compound, 1 part of sulfur as a vulcanizing agent and 3 parts of Nocceler TS as a vulcanizing accelerator were added, based on 100 parts of the material rubber NBR, followed by kneading for 10 minutes by means of a twin-roll mill cooled to 20° C. The resultant compound was molded by means of an extruder, which was so extruded around a stainless steel mandrel (support) of 6 mm in diameter as to be in the shape of a roller. After the heating-and-vulcanizing molding, the molded product was subjected to abrasion so as to have an outer diameter of 12 mm, thus forming an elastic layer on the support. The elastic layer had a resistivity of $7\times10^{7}$ Ω·cm.

On this elastic layer, a surface layer as shown below was formed by coating.

As a material for forming the surface layer 2*c*, polyvinyl butyral resin was used. To 100 parts of its ethanol solution (solid content: 50% by weight), 40 parts of conductive titanium oxide was added to prepare a coating fluid. Using the coating fluid, it was coated by dip coating to form a surface layer of 5 μm thick, thus obtaining roller-shaped conducting member (charging roller). The surface layer had a resistivity of $1\times10^{13}$ Ω·cm.

The same binder resin as that used to form the surface layer was made into a coating fluid, used as a clear coating fluid, which was then coated on an aluminum sheet to prepare a sample sheet for measuring the coefficient of static friction.

The coefficient of static friction $\mu s_B$ of the binder resin in the present Example was measured in the same manner as in Example 1 to find that it was 0.26.

The coefficient of static friction $\mu s$ of the charging roller surface in the present Example was also measured in the same manner as in Example 1 by the method as shown in FIG. 8, to find that it was 0.36.

The time constant τ of electric current of the charging roller was also calculated in the same manner as in Example 1. As the result, the time constant τ was:

$$\tau=0.019 \text{ [sec]}.$$

Therefore, the τ in Example 2 satisfies $\tau\leqq0.1$ [sec].

The ten-point average surface roughness Rz of the charging roller surface was 1.8 μm.

With regard to the charging roller thus obtained, images were evaluated in the same manner as in Example 1 on the excessive-charging uneven potential and on the fog due to toner adhesion.

Images were further evaluated on the excessive-charging uneven potential in the environment 3 (temperature 15° C., humidity 10%) while shifting the thickness of the charge transport layer. Results obtained are shown in Table 3. As shown in Table 3, good images free of any excessive-charging uneven potential or white spots were obtainable when the charge transport layer of the electrophotographic photosensitive member had a thickness of 40 μm or smaller.

Example 3

The procedure of Example 1 was repeated to make evaluation, except that the charging roller as the conducting member was constituted as described below.

| | |
|---|---|
| Epichlorohydrin rubber (three-dimensional copolymer) | 100 parts |
| Quatemary ammonium salt | 1.5 parts |
| Conductive carbon graphite | 30 parts |
| Calcium carbonate | 30 parts |
| Zinc oxide | 5 parts |
| Fatty acid | 2 parts |

The above materials were kneaded for 10 minutes by means of an internal mixer controlled to 60° C. Thereafter, 15 parts by weight of an ether-ester type plasticizer was added, based on 100 parts by weight of the epichlorohydrin rubber, followed by further kneading for 20 minutes by means of the internal mixer, having been cooled to 20° C., to prepare a material compound. To this compound, 1 part of sulfur as a vulcanizing agent and 1 part of Nocceler DM and 0.5 part of Nocceler TS as vulcanizing accelerators were added, based on 100 parts of the material rubber epichlorohydrin rubber, followed by kneading for 10 minutes by means of a twin-roll mill cooled to 20° C. The resultant compound was molded by means of an extruder, which was so extruded around a stainless steel mandrel (support) of 6 mm in diameter as to be in the shape of a roller. After the heating-and-vulcanizing molding, the molded product was so abraded as to be formed into a crown having rubber-part outer diameters of 12.0 mm at the middle and 11.9 mm at the both ends, thus forming an elastic layer on the support. The elastic layer had a resistivity of $5\times10^6$ Ω·cm.

On this elastic layer, a resistance layer as shown below was formed by coating.

As a material for the resistance layer 2*d*, 100 parts of epichlorohydrin rubber (a two-dimensional copolymer) was dispersed and dissolved in a toluene solvent to prepare a resistance layer coating fluid. This coating fluid was coated on the elastic layer 2*b* by dip coating to form a resistance layer 2*d* of 100 μm thick. The resistance layer had a resistivity of $8\times10^7$ Ω·cm.

On this resistance layer, a surface layer 2*c* as shown below was formed by coating.

As a material for the surface layer 2*c*, a fluorine resin copolymer obtained by copolymerizing a fluoroolefin (tetrafluoride type), a hydroxyalkyl vinyl ether and a carboxylic acid vinyl ester was used. To 100 parts of its ethanol solution (solid content: 50t by weight), 5 parts of an isocyanate (HDI) and 40 parts of conductive tin oxide were added to prepare a coating fluid. Using the coating fluid, it was coated by dip coating to form a surface layer of 5 μm thick, thus obtaining a roller-shaped conducting member (charging roller). The surface layer had a resistivity of $9\times10^{14}$ Ω·cm.

The same binder resin as that used to form the surface layer was made into a coating fluid, used as a clear coating fluid, which was then coated on an aluminum sheet to prepare a sample sheet for measuring the coefficient of static friction.

The coefficient of static friction $\mu s_B$ of the binder resin in the present Example was measured in the same manner as in Example 1 to find that it was 0.12.

The coefficient of static friction μs of the charging roller surface in the present Example was also measured in the same manner as in Example 1 to find that it was 0.25.

The time constant τ of electric current of the charging roller was also calculated in the same manner as in Example 1. As the result, the time constant τ was:

$$\tau=0.042 \text{ [sec]}.$$

Therefore, the τ in Example 3 satisfies $\tau \leqq 0.1$ [sec].

The ten-point average surface roughness Rz of the charging roller surface was 2.5 μm.

Example 4

The procedure of Example 1 was repeated to make an evaluation, except that the electrophotographic photosensitive member was constituted as described below.

Production of Electrophotographic Photosensitive Member

An electrophotographic photosensitive member was produced in the same manner as in Example 1 except that the binder resin of the charge transport layer was replaced with a polyarylate resin having the following structural formula (weight-average molecular weight: 83,000) and the layer was formed in a thickness of 35 μm.

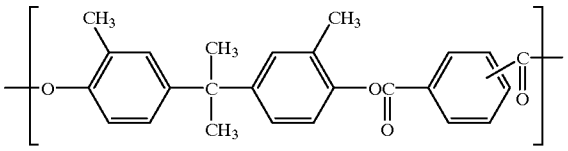

Example 5

Preparation of Charging Roller

| | |
|---|---|
| NBR (nitrile-butadiene rubber) | 100 parts |
| Conductive carbon black | 15 parts |
| Ester type plasticizer | 25 parts |
| Calcium carbonate | 30 parts |
| Zinc oxide | 5 parts |
| Fatty acid | 2 parts |

The above materials were kneaded for 10 minutes by means of an internal mixer controlled to 60° C., and thereafter further kneaded for 20 minutes by means of the internal mixer, having been cooled to 20° C., to prepare a material compound. To this compound, 1 part of sulfur as a vulcanizing agent and 3 parts of Nocceler TS as a vulcanizing accelerator were added, based on 100 parts of the material rubber NBR, followed by kneading for 10 minutes by means of a twin-roll mill cooled to 20° C. The resultant compound was molded by means of an extruder, which was so extruded around a stainless steel mandrel (support) of 6 mm in diameter as to be in the shape of a roller. After the heating-and-vulcanizing molding, the molded product was subjected to abrasion so as to have an outer diameter of 12 mm, thus forming an elastic layer on the support. The elastic layer had a resistivity of $6\times10^5$ Ω·cm.

On this elastic layer, a resistance layer a s shown below was formed by coating.

As a material for the resistance layer 2*d*, 100 parts of epichlorohydrin rubber (a two-dimensional copolymer) was dispersed and dissolved in a toluene solvent to prepare a resistance layer coating fluid. This coating fluid was coated on the elastic layer 2*b* by dip coating to form a resistance layer 2*d* of 50 μm thick. The resistance layer had a resistivity of $1\times10^8$ Ω·cm.

On this resistance layer, a surface layer as shown below was formed by coating.

As a material for the surface layer 2*c*, polyvinyl butyral resin was used. To 100 parts of its ethanol solution (solid content: 50t by weight), 35 parts of conductive titanium oxide was added to prepare a coating fluid. Using the coating fluid, it was coated by dip coating to form a surface layer of 15 $\mu$m thick, thus obtaining a roller-shaped conducting member (charging roller). The surface layer had a resistivity of $6\times10^{13}$ Ω·cm.

With regard to the charging roller thus obtained, roller characteristics were evaluated in the same manner as in Example 1.

The coefficient of static friction $\mu s_B$ of the binder resin of the charging roller surface layer in the present Example was 0.26.

The coefficient of static friction $\mu s_B$ of the charging roller surface in the present Example was 0.35.

The time constant τ of electric current of the charging roller was also calculated in the same manner as in Example 1. As the result, the time constant τ was:

$$\tau=0.067 \text{ [sec]}.$$

Therefore, the τ in Example 5 satisfies $\tau\leqq0.1$ [sec].

The ten-point average surface roughness Rz of the charging roller surface was 2.5 $\mu$m.

Production of Electrophotographic Photosensitive Member

An electrophotographic photosensitive member was produced in the same manner as in Example 1 except that the charge transport layer was formed in a thickness of 18 $\mu$m.

Using the above charging roller and electrophotographic photosensitive member, an evaluation was made in the same manner as in Example 1. Results obtained are shown in Table 1 and 2.

Example 6

A charging roller and an electrophotographic photosensitive member were produced in the same manner as in Example 1 except that the surface layer of the charging roller used therein was changed to be constituted as shown below.

| | |
|---|---|
| Urethane resin | 100 parts |
| Conductive titanium oxide | 60 parts |

As materials for the surface layer, the above materials were dispersed and dissolved in methyl ethyl ketone (MEK) to prepare a surface layer coating fluid. This coating fluid was coated on the elastic layer 2*b* by dip coating to form a surface layer of 10 $\mu$m thick, thus obtaining a roller-shaped conducting member (charging roller). The surface layer had a resistivity of $4\times10^{12}$ Ω·cm.

With regard to the charging roller thus obtained, roller characteristics were evaluated in the same manner as in Example 1.

The coefficient of static friction $\mu s_B$ of the binder resin of the charging roller surface layer in the present Example was 0.45.

The coefficient of static friction $\mu s$ of the charging roller surface in the present Example was 0.82.

The time constant τ of electric current of the charging roller in the present Example was:

$$\tau=0.033 \text{ [sec]}.$$

Therefore, the τ in Example 6 satisfies $\tau\leqq0.1$ [sec].

The ten-point average surface roughness Rz of the charging roller surface was 6.2 $\mu$m.

Comparative Example 1

A charging roller was produced in the following way.

| | |
|---|---|
| EPDM (ethylene-propylene terpolymer) | 100 parts |
| Conductive carbon black | 30 parts |
| Zinc oxide | 5 parts |
| Fatty acid | 2 parts |

The above materials were kneaded for 10 minutes by means of an internal mixer controlled to 60° C., and thereafter 15 parts of paraffin oil was added, based on 100 parts of EPDM, followed by further kneading for 20 minutes by means of the internal mixer, having been cooled to 20° C., to prepare a material compound. To this compound, 0.5 part of sulfur as a vulcanizing agent and 1 part of MBT (mercaptobenzothiazole), 1 part of TMTD (tetramethylthiurum disulfide) and 1.5 parts of ZnMDC as vulcanizing accelerators were added, based on 100 parts of the material rubber EPDM, followed by kneading for 10 minutes by means of a twin-roll mill cooled to 20° C. The resultant compound was molded by heating-and-vulcanizing molding by means of a press molding machine, which was so molded around a stainless steel mandrel (support) of 6 mm in diameter as to be in the shape of a roller of 12 mm in diameter, thereby forming an elastic layer on the support. The elastic layer had a resistivity of $7\times10^{3}$ Ω·cm.

On this elastic layer, a resistance layer as shown below was formed by coating.

| | |
|---|---|
| Polyurethane resin | 100 parts |
| Conductive carbon black | 15 parts |

As materials for the resistance layer 2*d*, the above materials were dispersed and dissolved in methyl ethyl ketone (MEK) to prepare a resistance layer coating fluid. This coating fluid was coated on the elastic layer 2*b* by dip coating to form a resistance layer 2*d* of 100 $\mu$m thick. The resistance layer had a resistivity of $5\times10^{10}$ Ω·cm.

On this resistance layer, a surface layer as shown below was further formed by coating.

| | |
|---|---|
| SEBS (styrene-ethylenebutylene-styrene rubber) | 100 parts |
| Conductive carbon black | 10 parts |

As materials for the surface layer 2*c*, the above materials were dispersed and dissolved in toluene solvent to prepare a surface layer coating fluid. Using this coating fluid, it was coated by dip coating to form a surface layer of 5 $\mu$m thick, thereby obtaining a roller-shaped conducting member (charging roller) was obtained. The surface layer had a resistivity of $8\times10^{13}$ Ω·cm.

Using the same coating fluid as that used to form the surface layer, it was coated on an aluminum sheet to prepare a sample sheet for measuring the coefficient of static friction.

The coefficient of static friction $\mu s_B$ of the binder resin of the charging roller surface layer in Comparative Example 1 was measured in the same manner as in Example 1 to find that it was 0.62.

The coefficient of static friction $\mu s$ of the charging roller surface was also measured in the same manner as in Example 1 to find that it was 1.07.

The time constant $\tau$ of electric current of the charging roller was also calculated in the same manner as in Example 1. As the result, the time constant $\tau$ was:

$$\tau=0.112 \text{ [sec]}.$$

Therefore, the $\tau$ in Comparative Example 1 does not satisfy $\tau \leqq 0.1$ [sec].

The ten-point average surface roughness Rz of the charging roller surface was 10.5 $\mu$m.

With regard to this charging roller, evaluation was made in the same manner as in Example 1. Results obtained are shown in Tables 1 and 2. Images reproduced on the electrophotographic apparatus making use of this charging roller caused blank areas and coarse images due to the excessive-charging uneven potential. Incidentally, the potential of the photosensitive member surface at its halftone image region was measured to find that the surface was charged in excess by −60 V in potential at the position corresponding to the second-round rotation of the photosensitive member. Also, in the many-sheet image reproduction running test, uneven image density caused by toner adhesion was seen.

Comparative Example 2

A charging roller was produced in the following way.

| | |
|---|---|
| NBR (nitrile-butadiene rubber) | 100 parts |
| Lithium perchlorate | 5 parts |
| Calcium carbonate | 30 parts |
| Zinc oxide | 5 parts |
| Fatty acid | 2 parts |

The above materials were kneaded for 10 minutes by means of an internal mixer controlled to 60° C., and thereafter 20 parts of a plasticizer DOS, based on 100 parts of NBR, followed by further kneading for 20 minutes by means of the internal mixer, having been cooled to 20° C., to prepare a material compound. To this compound, 1 part of sulfur as a vulcanizing agent and 3 parts of Nocceler TS as a vulcanizing accelerator were added, based on 100 parts of the material rubber NBR, followed by kneading for 10 minutes by means of a twin-roll mill cooled to 20° C. The resultant compound was molded by means of an extruder, which was so extruded around a stainless steel mandrel (support) of 6 mm in diameter as to be in the shape of a roller. After the heating-and-vulcanizing molding, the molded product was subjected to abrasion so as to have an outer diameter of 12 mm, thereby forming an elastic layer on the support. The elastic layer had a resistivity of $2\times10^5$ $\Omega\cdot$cm.

| | |
|---|---|
| Polyurethane elastomer | 100 parts |
| Conductive carbon black | 5 parts |

As materials for the surface layer 2*c*, the above materials were dispersed and dissolved in methyl ethyl ketone (MEK) solvent to prepare a surface layer coating fluid. Using this coating fluid, it was coated by dip coating to form a surface layer of 10 $\mu$m thick, thus a roller-shaped conducting member (charging roller) was obtained. The surface layer had a resistivity of $5\times10^{13}$ $\Omega\cdot$cm.

Using the same coating fluid as that used to form the surface layer, it was coated on an aluminum sheet to prepare a sample sheet for measuring the coefficient of static friction.

The coefficient of static friction psB of the binder resin of the charging roller surface layer in Comparative Example 2 was measured in the same manner as in Example 1 to find that it was 0.57.

The coefficient of static friction $\mu s$ of the charging roller surface was also measured in the same manner as in Example 1 to find that it was 1.03.

The time constant $\tau$ of electric current of the charging roller was also calculated in the same manner as in Example 1. As the result, the time constant $\tau$ was:

$$\tau=0.102 \text{ [sec]}.$$

Therefore, the $\tau$ in Comparative Example 2 does not satisfy $\tau \leqq 0.1$ [sec].

The ten-point average surface roughness Rz of the charging roller surface was 12.1 $\mu$m.

With regard to this charging roller, an evaluation was made in the same manner as in Example 1. Results obtained are shown in Tables 1 and 2. Images reproduced on the electrophotographic apparatus making use of this charging roller caused blank areas and coarse images due to the excessive-charging uneven potential. Incidentally, the potential of the photosensitive member surface at its halftone image region was measured to find that the surface was charged in excess by −40 V in potential at the position corresponding to the second-round rotation of the photosensitive member. Also, in the many-sheet image reproduction running test, uneven image density caused by toner adhesion was seen.

Comparative Example 3

A charging roller and an electrophotographic photosensitive member were produced in the same manner as in Example 1 except that the charging roller as the conducting member was constituted as described below.

| | |
|---|---|
| NBR (nitrile-butadiene rubber) | 100 parts |
| Lithium perchlorate | 5 parts |
| Ester type plasticizer | 15 parts |
| Calcium carbonate | 30 parts |
| Zinc oxide | 5 parts |
| Fatty acid | 2 parts |

The above materials were kneaded for 10 minutes by means of an internal mixer controlled to 60° C., and thereafter further kneaded for 20 minutes by means of the internal mixer, having been cooled to 20° C., to prepare a material compound. To this compound, 1 part of sulfur as a vulcanizing agent and 3 parts of Nocceler TS as a vulcanizing accelerator were added, based on 100 parts of the material rubber NBR, followed by kneading for 10 minutes by means of a twin-roll mill cooled to 20° C. The resultant compound was molded by means of an extruder, which was so extruded around a stainless steel mandrel (support) of 6 mm in diameter as to be in the shape of a roller. After the heating-and-vulcanizing molding, the molded product was subjected to abrasion so as to have an outer diameter of 12 mm, thereby scanning an elastic layer on the support. The elastic layer had a resistivity of $1\times10^8$ $\Omega\cdot$cm.

On this elastic layer, a surface layer as shown below was formed by coating.

As a material for forming the surface layer 2*c*, polyurethane resin was used. Using its methyl ethyl ketone (MEK) solution (solid content: 25% by weight), the solution was coated by dip coating to form a surface layer of 30 $\mu$m thick, thus a roller-shaped conducting member (charging roller) was obtained. The surface layer had a resistivity of $1\times10^{14}$ $\Omega\cdot$cm.

Using the coating fluid used to form the surface layer, it was coated on an aluminum sheet to prepare a sample sheet for measuring the coefficient of static friction.

The coefficient of static friction $\mu s_B$ of the binder resin of the charging roller surface layer in the present Comparative Example was measured in the same manner as in Example 1 to find that it was 0.40.

The coefficient of static friction $\mu$s of the charging roller surface in the present Comparative Example was also measured in the same manner as in Example 1 to find that it was 0.81.

The time constant $\tau$ of electric current of the charging roller was also calculated in the same manner as in Example 1. As the result, the time constant $\tau$ was:

$$\tau=0.125 \text{ [sec]}.$$

Therefore, the $\tau$ in Comparative Example 3 does not satisfy $\tau\leqq0.1$ [sec].

The ten-point average surface roughness Rz of the charging roller surface was 8.0 $\mu$m.

With regard to this charging roller, an evaluation was made in the same manner as in Example 1. The results obtained are shown in Tables 1 and 2. Images reproduced on the electrophotographic apparatus making use of this charging roller caused blank areas and coarse images due to the excessive-charging uneven potential. Incidentally, the potential of the photosensitive member surface at its halftone image region was measured to find that the surface was charged in excess by −25 V in potential at the position corresponding to the second-round rotation of the photosensitive member. Also, in the many-sheet image reproduction running test, uneven image density caused by toner adhesion was seen.

TABLE 1

| | | Image evaluation Environment | | |
|---|---|---|---|---|
| | Time constant $\tau$ | 1 | 2 | 3 |
| Example: | | | | |
| 1 | $\tau$ = 0.021 [sec] | AA | AA | A |
| 2 | $\tau$ = 0.019 [sec] | AA | AA | A |
| 3 | $\tau$ = 0.042 [sec] | A | AA | A |
| 4 | $\tau$ = 0.021 [sec] | A | A | B |
| 5 | $\tau$ = 0.067 [sec] | A | AA | A |
| 6 | $\tau$ = 0.033 [sec] | AA | AA | A |
| Comparative Example: | | | | |
| 1 | $\tau$ = 0.112 [sec] | B | A | C |
| 2 | $\tau$ = 0.102 [sec] | A | A | C |
| 3 | $\tau$ = 0.125 [sec] | A | A | C |

TABLE 2

| | Evaluation on image fog | | | | | |
|---|---|---|---|---|---|---|
| | Environment 1 | | Environment 2 | | Environment 3 | |
| | Initial stage | 10,000 sheets | Initial stage | 10,000 sheet | Initial stage | 10,000 sheets |
| Example: | | | | | | |
| 1 | AA | AA | AA | A | AA | A |
| 2 | AA | A | AA | A | A | B |
| 3 | AA | A | A | A | A | B |
| 4 | AA | A | AA | A | AA | A |
| 5 | AA | A | AA | A | A | A |
| 6 | AA | B | AA | A | AA | B |
| Comparative Example: | | | | | | |
| 1 | B | B | A | C | B | C |
| 2 | A | B | A | C | B | C |
| 3 | A | A | A | A | B | C |

TABLE 3

| | Layer thickness of charge transport layer | Image evaluation |
|---|---|---|
| | ($\mu$m) | |
| Example 2: | | |
| 12 | AA | |
| 15 | AA | |
| 18 | AA | |
| 20 | AA | |
| 23 | AA | |
| 25 | AA | |
| 30 | A | |
| 35 | A | |
| 40 | B | |
| 42 | C | |
| 45 | C | |

What is claimed is:

1. A process cartridge comprising an electrophotographic photosensitive member and a conducting member disposed in contact with the electrophotographic photosensitive member and to which a voltage is to be applied, said electrophotographic photosensitive member and conducting member being supported as one unit and being detachably mountable to the main body of an electrophotographic apparatus, said electrophotographic photosensitive member comprising a support, and a charge generation layer and a charge transport layer provided in this order on said support, said charge transport layer having a thickness of from 12 $\mu$m to 40 $\mu$m, and said conducting member comprising a conductive support and a covering layer provided thereon; the time constant $\tau$ of electric current of said conducting member being 0.1 second or shorter.

2. A process cartridge according to claim 1, wherein said voltage to be applied is only a direct voltage.

3. A process cartridge according to claim 1, wherein said charge transport layer has a thickness of from 12 $\mu$m to 23 $\mu$m.

4. A process cartridge according to claim 1, wherein said charge transport layer has a thickness of from 12 $\mu$m to 18 $\mu$m.

5. A process cartridge according to claim 1, wherein said time constant $\tau$ is 0.05 second or shorter.

6. A process cartridge according to claim 1, wherein said time constant $\tau$ is 0.00001 second or longer.

7. A process cartridge according to claim 1, wherein said covering layer comprises an elastic layer and a layer provided on the elastic layer.

8. A process cartridge according to claim 7, wherein said layer provided on the elastic layer contains a conducting agent having an electron-conducting mechanism.

9. A process cartridge according to claim 7, wherein said elastic layer has a resistivity below $10^{10}$ Ω·cm.

10. A process cartridge according to claim 7, wherein said layer provided on the elastic layer is a resistance layer.

11. A process cartridge according to claim 10, wherein said resistance layer has a resistivity of from $10^4$ Ω·cm to $10^{10}$ Ω·cm.

12. A process cartridge according to claim 7, wherein said layer provided on the elastic layer is a surface layer.

13. A process cartridge according to claim 12, wherein said surface layer has a resistivity of from $10^4$ Ω·cm to $10^{15}$ Ω·cm.

14. A process cartridge according to claim 7, wherein said layer provided on the elastic layer comprises a resistance layer and a surface layer.

15. A process cartridge according to claim 14, wherein said resistance layer has a resistivity of from $10^4$ Ω·cm to $10^{10}$ Ω·cm and said surface layer has a resistivity of from $10^4$ Ω·cm to $10^{15}$ Ω·cm.

16. A process cartridge according to claim 1, wherein the surface of said conducting member has a coefficient of static friction of 1.0 or lower.

17. A process cartridge according to claim 1, wherein said conducting member has a surface roughness of 10 μm or smaller.

18. A process cartridge according to claim 1, wherein said electrophotographic apparatus employs a cleaning-at-development system.

19. An electrophotographic apparatus comprising an electrophotographic photosensitive member and a conducting member disposed in contact with the electrophotographic photosensitive member and to which a voltage is to be applied, said electrophotographic photosensitive member comprising a support, and a charge generation layer and a charge transport layer provided in this order on said support, said charge transport layer having a thickness of from 12 μm to 40 μm, and said conducting member comprising a conductive support and a covering layer provided thereon; the time constant τ of electric current of said conducting member being 0.1 second or shorter.

20. An electrophotographic apparatus according to claim 19, wherein said voltage to be applied is only a direct voltage.

21. An electrophotographic apparatus according to claim 19, wherein said charge transport layer has a thickness of from 12 μm to 23 μm.

22. An electrophotographic apparatus according to claim 19, wherein said charge transport layer has a thickness of from 12 μm to 18 μm.

23. An electrophotographic apparatus according to claim 19, wherein said time constant τ is 0.05 second or shorter.

24. An electrophotographic apparatus according to claim 19, wherein said time constant τ is 0.00001 second or longer.

25. An electrophotographic apparatus according to claim 19, wherein said covering layer comprises an elastic layer and a layer provided on the elastic layer.

26. An electrophotographic apparatus according to claim 25, wherein said layer provided on the elastic layer contains a conducting agent having an electron-conducting mechanism.

27. An electrophotographic apparatus according to claim 25, wherein said elastic layer has a resistivity below $10^{10}$ Ω·cm.

28. An electrophotographic apparatus according to claim 25, wherein said layer provided on the elastic layer is a resistance layer.

29. An electrophotographic apparatus according to claim 28, wherein said resistance layer has a resistivity of from $10^4$ Ω·cm to $10^{10}$ Ω·cm.

30. An electrophotographic apparatus according to claim 25, wherein said layer provided on the elastic layer is a surface layer.

31. An electrophotographic apparatus according to claim 30, wherein said surface layer has a resistivity of from $10^4$ Ω·cm to $10^{15}$ Ω·cm.

32. An electrophotographic apparatus according to claim 25, wherein said layer provided on the elastic layer comprises a resistance layer and a surface layer.

33. An electrophotographic apparatus according to claim 32, wherein said resistance layer has a resistivity of from $10^4$ Ω·cm to $10^{10}$ Ω·cm and said surface layer has a resistivity of from $10^4$ Ω·cm to $10^{15}$ Ω·cm.

34. An electrophotographic apparatus according to claim 19, wherein the surface of said conducting member has a coefficient of static friction of 1.0 or lower.

35. An electrophotographic apparatus according to claim 19, wherein said conducting member has a surface roughness of 10 μm or smaller.

36. An electrophotographic apparatus according to claim 19, wherein said electrophotographic apparatus employs a cleaning-at-development system.

* * * * *

UNITED STATES PATENT AND TRADEMARK OFFICE

CERTIFICATE OF CORRECTION

PATENT NO. : 6,337,962 B1
DATED : January 8, 2002
INVENTOR(S) : Hiroshi Inoue et al.

It is certified that error appears in the above-identified patent and that said Letters Patent is hereby corrected as shown below:

Title page,
Item [57], ABSTRACT,
Line 2, "stive" should read -- sitive --.
Line 8, "photosenstive" should read -- photosensitive --.
Line 9, "trasport" should read -- transport --.

Column 1,
Line 52, "($V^{TH}$)" should read -- ($V_{TH}$) --.
Line 65, "($V^{TH}$)" should read -- ($V_{TH}$) --.

Column 2,
Line 23, ".positions" should read -- positions --.

Column 5,
Line 20, "denotes" (1st occurrence) should read -- both. The data were obtained using an apparatus as shown in Fig. 5, where a direct voltage is applied to a conducting member and electric-current values of the conducting member are read into a recorder. In Fig. 5, reference numeral 2 denotes the conducting member; 11 denotes --.
Line 26, "when" should read -- when, --.

Column 9,
Line 8, "invention depends" should read -- depends --.
Line 14, "T" should read -- $\tau$ --.
Line 42, "impartment" should read -- impairment --.

Column 12,
Line 7, "$\tau$=0" should read -- t=0 --.

Column 14,
Line 18, "Quatemary" should read -- Quaternary --.

UNITED STATES PATENT AND TRADEMARK OFFICE

CERTIFICATE OF CORRECTION

PATENT NO. : 6,337,962 B1
DATED : January 8, 2002
INVENTOR(S) : Hiroshi Inoue et al.

It is certified that error appears in the above-identified patent and that said Letters Patent is hereby corrected as shown below:

Column 16,
Line 26, "psB" should read -- $\mu s_B$ --.
Line 27, "arbitrary five" should read -- five arbitrary --.
Line 34, "us" should read -- μs --.
Line 37, "$\mu$sof" should read -- $\mu$s of --.

Column 17,
Line 14, "VD" should read -- $V_D$ --.
Line 18, "are a" should read -- are --.
Line 27, "describe" should read -- described --.

Column 19,
Line 41, "for" should read -- for forming --.
Line 45, "50t" should read -- 50% --.

Column 20,
Line 56, "a s" should read -- as --.

Column 21,
Line 3, "50t" should read -- 50% --.

Column 22,
Line 58, "roller) was obtained." should read -- roller). --.

Column 24,
Line 4, "psB" should read -- $\mu s_B$ --.
Line 63, "scanning" should read -- forming --.

Signed and Sealed this

Fourth Day of February, 2003

JAMES E. ROGAN
*Director of the United States Patent and Trademark Office*